US005231855A

United States Patent [19]

Seta et al.

[11] Patent Number: 5,231,855

[45] Date of Patent: Aug. 3, 1993

[54] KNITTING NEEDLES FOR CIRCULAR KNITTING MACHINE AND THEIR USE

[75] Inventors: Kazuo Seta, Tanabe; Yuji Kawase, Nishimuro, both of Japan

[73] Assignee: Fukuhara Needle Co., Ltd., Wakayama, Japan

[21] Appl. No.: 848,224

[22] Filed: Mar. 9, 1992

[30] Foreign Application Priority Data

Jun. 25, 1991 [JP] Japan ..... 3-181960

[51] Int. Cl.[5] ..... D04B 35/02

[52] U.S. Cl. ..... 66/123

[58] Field of Search ..... 66/123

[56] References Cited

U.S. PATENT DOCUMENTS 4,089,192 5/1978 Kohorn ..... 66/123 X
4,452,053 6/1984 Egbers et al. ..... 66/123
4,625,527 12/1986 Fukuhara ..... 66/123

FOREIGN PATENT DOCUMENTS 2408567 9/1975 Fed. Rep. of Germany ..... 66/123

OTHER PUBLICATIONS

*72 Feed Interlock Knitting at 36 R.P.M.*, Knitting International Dec. 1978, vol. 85 No. 1020 p. 42 (2 pages).

*Primary Examiner*—Clifford D. Crowder
*Assistant Examiner*—John J. Calvert
*Attorney, Agent, or Firm*—Wegner, Cantor, Mueller & Player

[57] ABSTRACT

Damages to the butt of a needle having bridges used in a raceway circular knitting machine, an eight-lock circular knitting machine or an interlock circular knitting machine can be prevented by using a combination of at least two kinds of needles with different butt positions in the same knitting machine. The butt of a needle is positioned right next to a bridge of the adjacent needle.

6 Claims, 2 Drawing Sheets

KNITTING NEEDLES FOR CIRCULAR KNITTING MACHINE AND THEIR USE

BACKGROUND OF THE INVENTION

The present invention relates to knitting needles for a raceway circular knitting machine, an eight-lock circular knitting machine and an interlock circular knitting machine and their use.

Knitting needles are placed with their backs contacting the needle beds of the needle grooves in a cylinder of a circular knitting machine. They are often used in a combination of several kinds of needles with different butt positions within the same knitting machine. The knitting needles rotate at a high speed as the cylinder rotates, and, at the same time, the needle butts perform high-speed reciprocating movement as they are activated by cams in fixed cam holders that are so arranged to face the needle butts.

Various types of knitting needles that withstand high-speed knitting have so far been invented. For example, it is known to be effective to provide cutouts on the needle body that is between the butt and the needle head alternately from the upper side and the lower side, which gives the entire needle a meanderform by forming bridges therein.

The needles having bridges are more effective compared with the needles in the past. However, a problem have arisen when the knitting speed becomes faster and the force applied by the cam to the butt becomes large enough to force the butt to incline in the opposite direction to the rotary movement of the cylinder. When two needles with different butt positions are placed adjacent to each other in which the butt of a given needle is not adjoined by a bridge of the adjacent needle, as is the case in prior art techniques, a gap is made between the insert wall or insert piece of the cylinder toward which the butt inclines and the next insert wall of the cylinder. As a result, the butt is likely to get damaged, and the damage of the butt could cause damages to the insert wall and the cylinder. The damage to the butt of a needle could also trigger damage to butts of several needles in a chain reaction. Should this happen, damage to the cylinder will be too serious for repair, and replacement will be inevitable. The object of the present invention is to solve this problem.

SUMMARY OF THE INVENTION

An aspect of the knitting needles for a circular knitting machine in accordance with of the present invention comprises at least one kind of knitting needle for a circular knitting machine having a needle head consisting of a hook and a latch, at least a butt and a needle rear end, at least a bridge between the butt and the needle head, and at least a bridge between the butt and the needle rear end; at least one kind of knitting needle for a circular knitting machine having a needle head consisting of a hook and latch, at least a butt and a needle rear end, and, at least a bridge between the butt and the needle head wherein the butt and the needle rear end are formed as a unit; said set of knitting needles for a circular knitting machine being used in a combination in the same knitting machine, in which the butt of any one needle always corresponds to bridges of the remaining needles.

Another aspect of the knitting needles for a circular knitting machine in accordance with the present invention comprises at least two kinds of knitting needle for a circular knitting machine having a needle head consisting of a hook and a latch, at least a butt and a needle rear end, and, at least a bridge between the butt and the needle head, and at least a bridge between the butt and the needle rear end; said set of knitting needles for a circular knitting machine being used in a combination in the same knitting machine, in which the butt of any one needle always corresponds to bridges of the remaining needles.

Still another aspect of the present invention in accordance with the present invention is a method of use of the knitting needles characterized by the arrangement in which at least one kind of knitting needle for a circular knitting machine having a needle head consisting of a hook and a latch, at least a butt and a needle rear end, and, at least a bridge between the butt and the needle head, and at least a bridge between the butt and the needle rear end; and at least one kind of knitting needle for a circular knitting machine having a needle head consisting of a hook and latch, at least a butt and a needle rear end, and, at least a bridge between the butt and the needle head wherein the butt and the needle rear end are formed as a unit; are used in a combination in the same knitting machine; and in which the butt of any one needle is always placed right next to a bridge of the adjacent needle.

Still another aspect in accordance with the present invention is a use of the knitting needles characterized by the arrangement in which at least two kinds of knitting needles for a circular knitting machine, having a needle head consisting of a hook and a latch, at least a butt and a needle rear end, and, at least a bridge between the butt and the needle head, and at least a bridge between the butt and the needle rear end, are used in a combination in the same knitting machine; in which the butt of any one needle is always placed right next to a bridge of the adjacent needle.

According to the present invention, between the insert wall of the cylinder toward which a butt inclines and the next insert wall of the cylinder, there is always a bridge of the adjacent needle so that the butt is unlikely to get damaged. Even if it does get damaged, the insert wall and the cylinder get damaged much less frequently.

BRIEF DESCRIPTION OF THE DRAWING

Embodiments of the present invention will now be described with reference to the accompanying drawings in which.

DETAILED DESCRIPTION

Figures 1A, 1B, 1C, 1D:
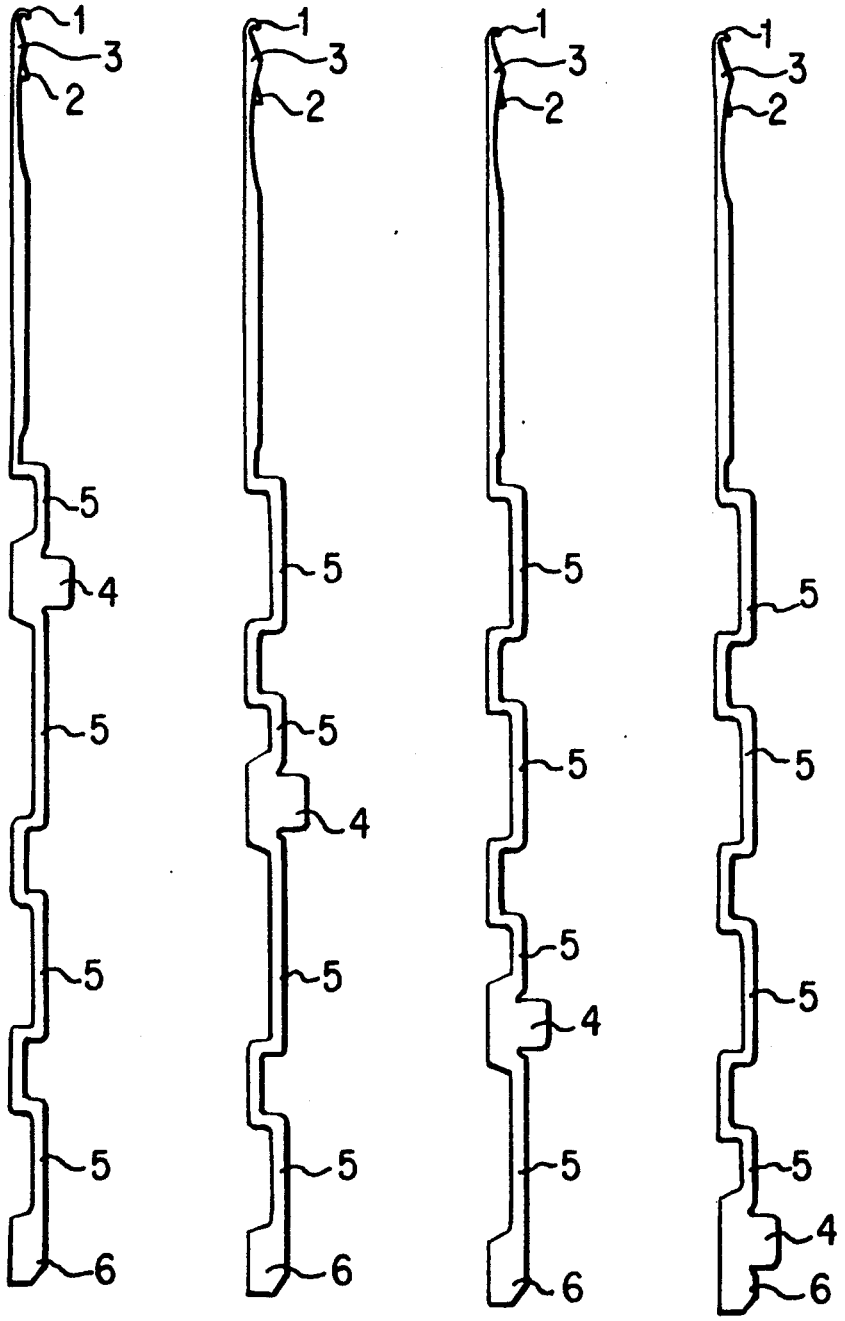
FIGS. 1 (*a*)–(*d*) are a set of knitting needles for either a raceway circular knitting machine, an eight-lock circular knitting machine or an interlock circular knitting machine that are used in a combination in the same knitting machine.

The four kinds of knitting needles shown in FIG. 1 shows a combination of four kinds used in the present invention. However, as long as there are at least two kinds of needles, the present invention is materialized.

Each of the three needles (a), (b) and (c) shown in FIG. 1 has a needle head 3 consisting of a hook 1 and a latch 2, and at least a butt 4 and a needle rear end 6. There is at least a bridge 5 between the butt 4 and the needle head 3. Moreover, there is at least a bridge between the butt 4 and the needle rear end 6.

The needle (d) shown in FIG. 1 has a needle head 3 consisting of a hook 1 and a latch 2, and at least a butt and a needle rear end 6. There is at least a bridge 5 between the butt 4 and the needle head 3. Needle (d) differs from needles (a)-(c) in that its butt 4 and needle rear end 6 are formed as a unit.

The present invention can also be used in a combination of only two of the (a)-(c) kinds without using needle (d) shown in FIG. 1, although this combination is not illustrated in the drawing.

The characteristic of the present invention is that the butt 4 of each of the needles (a)-(d) always corresponds to bridges 5 of the remaining needles.

As is obvious from the above description, the knitting needles of the present invention are used in such a way that when using the needles (a)-(d) shown in FIG. 1 in a combination of at least two kinds in the same knitting machine, the butt 4 of a needle is always placed right next to a bridge 5 of the adjacent needle. When at least two kinds of needles (a)-(c) only are combined for use in the same knitting machine, the butt 4 of a needle is placed right next to a bridge 5 of the adjacent needle.

Figure 2:
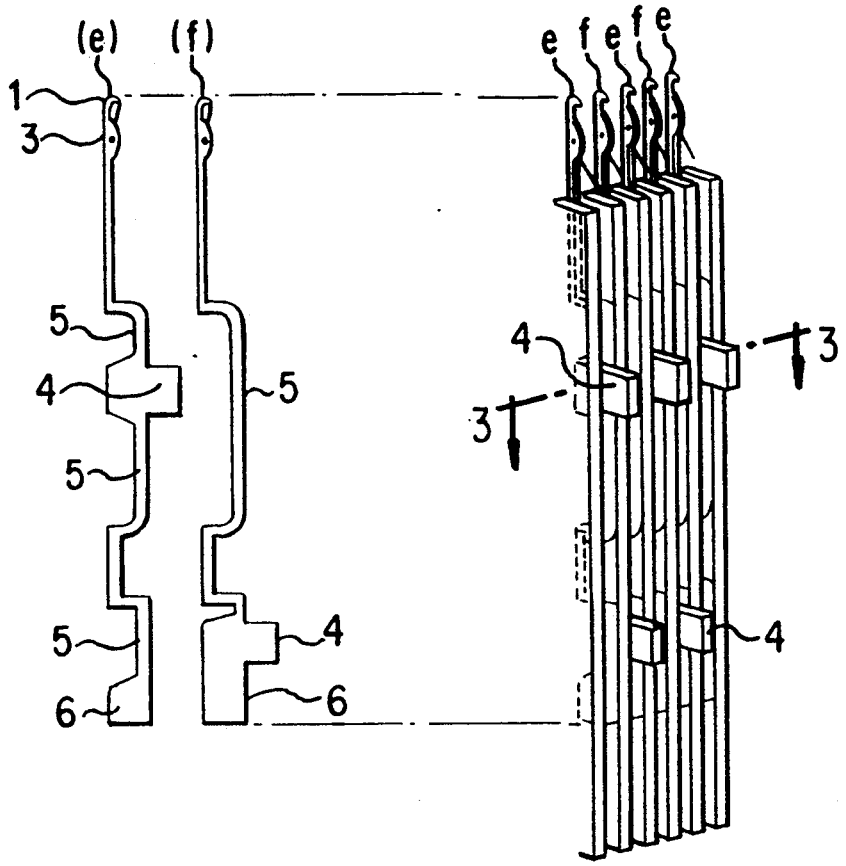
FIG. 2 is a perspective view of two kinds of knitting needles placed in a cylinder according to the present invention.
Figure 3:
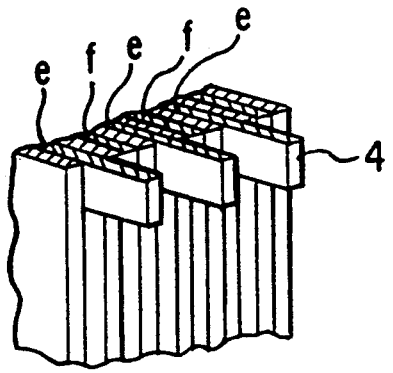
FIG. 3 is a perspective sectional view taken along the line 3—3 in FIG. 2.

A use of the needles in accordance with the present invention is illustrated in FIG. 2 and FIG. 3, in which only two kinds of needles are used. Each of the two needles (e) and (f) are placed between the insert walls in the cylinder in the order of (e)-(f)-(e)-(f)-(e).

The needles (e) and (f) in FIG. 2 are a little different from the ones in FIG. 1. The needle (e) is similar to the needle (c) and the needle (f) to the needle (d) in FIG. 1, but the needles (e) and (f) in FIG. 2 are shorter than the needles (c) and (d) in FIG. 1 because two bridges 5 between the needle head and the butt are omitted in each needle.

As is apparent from FIG. 3, the butt 4 of a needle is placed right next to a bridge 5 of the adjacent needle.

According to the present invention, since there is always a bridge between the insert wall of the cylinder toward which a butt inclines and the next insert wall of the cylinder, the butt is unlikely to get damaged. Even if it does get damaged, the insert wall and cylinder get damaged much less frequently. As a result, the present invention improves durability of knitting needles and cylinders.

We claim:

1. A circular knitting machine comprising a set of knitting needles comprising:

at least three kinds of needles comprising:

at least one of said kinds of knitting needles for a circular knitting machine having a needle head comprising a hook and a latch, at least a butt and a needle rear end, and at least a bridge;

at least one of said kinds of knitting needles for a circular knitting machine having a needle head comprising a hook and a latch, at least a butt and a needle rear end, at least a bridge between the butt and the needle head, and at least a bridge between the butt and the needle rear end; and at least one of said kinds of knitting needles for a circular knitting machine having a needle head comprising a hook and a latch, at least a butt and a needle rear end, and at least a bridge between the butt and the needle head, wherein the butt and the needle rear end are formed as a unit;

said set of knitting needles being used in a combination in the same knitting machine, in which the butt of any one kind of needle always corresponds to bridges of the remaining kinds of needles.

2. A circular knitting machine comprising a set of knitting needles comprising:

at least three kinds of needles comprising:

at least one of said kinds of knitting needles for a circular knitting machine having a needle head comprising a hook and a latch, at least a butt and a needle rear end, and at least a bridge; and at least two of said kinds of knitting needles for a circular knitting machine having a needle head comprising a hook and a latch, at least a butt and a needle rear end, at least a bridge between the butt and the needle head, and at least a bridge between the butt and the needle rear end and wherein the butts of the at least two of said kinds of knitting needles are placed at different levels on each of the needles;

said set of knitting needles being used in a combination in the same knitting machine, in which the butt of any one kind of needle always corresponds to bridges of the remaining kinds of needles.

3. A set of knitting needles for use in a circular knitting machine comprising:

at least three kinds of needles comprising:

at least one of said kinds of knitting needles for a circular knitting machine having a needle head comprising a hook and a latch, at least a butt and a needle rear end, and at least a bridge;

at least one of said kinds of knitting needles for a circular knitting machine having a needle head comprising a hook and a latch, at least a butt and a needle rear end, at least a bridge between the butt and the needle head, and at least a bridge between the butt and the needle rear end; and at least one of said kinds of knitting needles for a circular knitting machine having a needle head comprising a hook and a latch, at least a butt and a needle rear end, and at least a bridge between the butt and the needle head, wherein the butt and the needle rear end are formed as a unit;

said set of knitting needles being used in a combination in the same knitting machine, in which the butt of any one kind of needle always corresponds to bridges of the remaining kinds of needles.

4. A set of knitting needles for use in a circular knitting machine comprising:

at least three kinds of needles comprising:

at least one of said kinds of knitting needles for a circular knitting machine having a needle head comprising a hook and a latch, at least a butt and a needle rear end, and at least a bridge; and at least two of said kinds of knitting needles for a circular knitting machine having a needle head comprising a hook and a latch, at least a butt and a needle rear end, at least a bridge between the butt and the needle head, and at least a bridge between the butt and the needle rear end and wherein the butts of the at least two of said kinds of knitting needles are placed at different levels on each of the needles;

said set of knitting needles being used in a combination in the same knitting machine, in which the butt of any one kind of needle always corresponds to bridges of the remaining kinds of needles.

5. A method of using a set of knitting needles comprising the step of providing at least three kinds of knitting needles in a combination, in the same knitting machine, wherein there is provided at least one of said kinds of knitting needles for a circular knitting machine having a needle head comprising a hook and a latch, at least a butt and a needle rear end, and at least a bridge;

at least one of said kinds of knitting needles for a circular knitting machine having a needle head comprising a hook and a latch, at least a butt and a needle rear end, at least a bridge between the butt and the needle head, and at least a bridge between the butt and the needle rear end; and at least one of said kinds of knitting needles for a circular knitting machine having a needle head comprising a hook and latch, at least a butt and a needle rear end, and, at least a bridge between the butt and the needle head, wherein the butt and the needle rear end are formed as a unit;

using said set of knitting needles in said combination in said same knitting machine, by placing the butt of any one needle right next to a bridge of an adjacent needle.

6. A method of using a set of knitting needles comprising the step of providing at least three kinds of knitting needles in a combination, in the same knitting machine, wherein there is provided at least one of said kinds of knitting needles for a circular knitting machine having a needle head comprising a hook and a latch, at least a butt and a needle rear end, and at least a bridge; and at least two of said kinds of knitting needles for a circular knitting machine having a needle head comprising a hook and a latch, at least a butt and a needle rear end, at least a bridge between the butt and the needle head, and at least a bridge between the butt and the needle rear end and wherein the butts of the at least two of said kinds of needles are placed at different levels on each of the needles;

using said set of knitting needles in said combination in such a way that the butts of different of said at least three kinds of needles are established at different positions in the same knitting machine by placing the butt of any one needle right next to a bridge of an adjacent needle.

* * * * *